US005383560A

United States Patent [19]

Gueret

[11] Patent Number: 5,383,560

[45] Date of Patent: Jan. 24, 1995

[54] CASE, INTER ALIA FOR MAKE-UP PRODUCTS, COMPRISING A CLOSING DEVICE THAT CAN BE OPERATED FROM THE OUTSIDE WITH AID OF A PUSH BUTTON

[75] Inventor: Jean-Louis Gueret, Paris, France

[73] Assignee: L'Oreal, Paris, France

[21] Appl. No.: 102,497

[22] Filed: Aug. 5, 1993

Related U.S. Application Data

[63] Continuation of Ser. No. 845,814, Mar. 9, 1992, abandoned, which is a continuation of Ser. No. 620,006, Nov. 30, 1990, abandoned.

[30] Foreign Application Priority Data

Dec. 1, 1989 [FR] France ..... 89 15867

[51] Int. Cl.[6] ..... B65D 69/00

[52] U.S. Cl. ..... 206/581; 206/1.5; 206/823

[58] Field of Search ..... 206/581, 527, 1.5, 823; 220/324, 326

[56] References Cited

U.S. PATENT DOCUMENTS

| | | | |
|---|---|---|---|
| Re. 20,986 | 1/1939 | Kreisler | 220/35 |
| 1,632,863 | 10/1926 | Weber | 292/80 |
| 1,690,552 | 11/1928 | Reutter | 220/326 |
| 1,755,908 | 4/1930 | Babbitt | 220/326 |
| 1,931,216 | 10/1933 | Zell | 220/55 |
| 4,685,558 | 4/1986 | Filiz | 206/1.5 |
| 4,917,131 | 4/1990 | Contreras, Sr. | 132/301 |

FOREIGN PATENT DOCUMENTS

| | | | |
|---|---|---|---|
| 0337220 | 4/1989 | European Pat. Off. . | |
| 2527058 | 5/1982 | France . | |
| 2584583 | 7/1985 | France . | |
| 2600240 | 12/1987 | France | 206/581 |
| 805909 | 6/1951 | Germany | 220/326 |
| 302441 | 10/1932 | Italy | 220/55 |
| 2202513A | 9/1988 | United Kingdom | 206/823 |
| 2217301 | 2/1989 | United Kingdom . | |

*Primary Examiner*—Paul T. Sewell
*Assistant Examiner*—Thomas P. Hilliard
*Attorney, Agent, or Firm*—Cushman, Darby & Cushman

[57] ABSTRACT

Case comprising a closing device including a first element consisting of a circular body, especially a sphere (15), mounted on a rod (16) fixed to the lid and a second element including a ramp (17) and two flexible guides (18, 18'), preferably diverging in the ascending direction of the ramp, this second element being integral with a push-button (19) that can be operated from the outside of the case. When the push-button (19) is displaced, the second element of the closing device is displaced, so that the sphere (15) is forced to move up the ramp (17) and to move between the flexible guides (18, 18') until it is ejected. The box is then half-open.

1 Claim, 4 Drawing Sheets

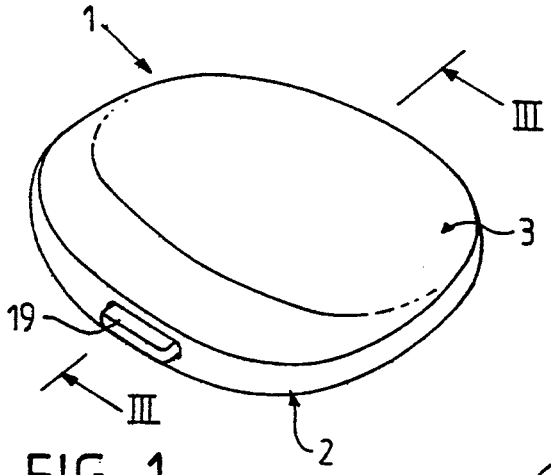
FIG. 1
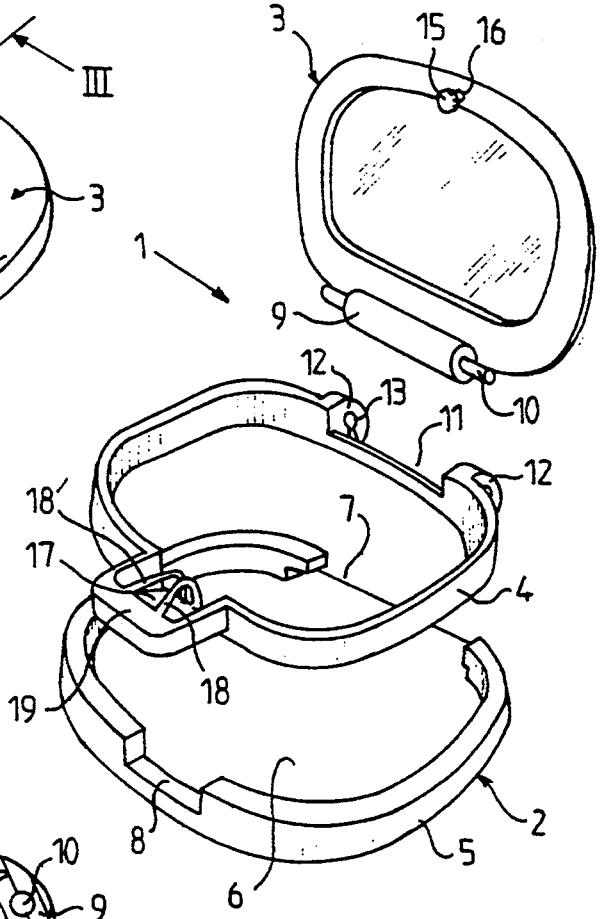
FIG. 2
FIG. 3
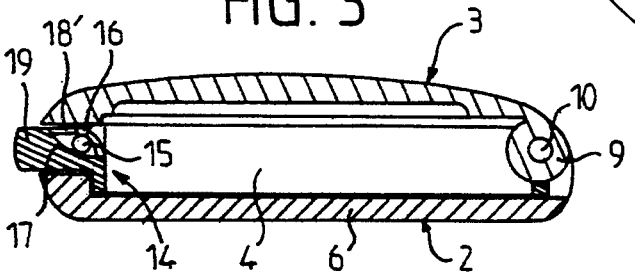
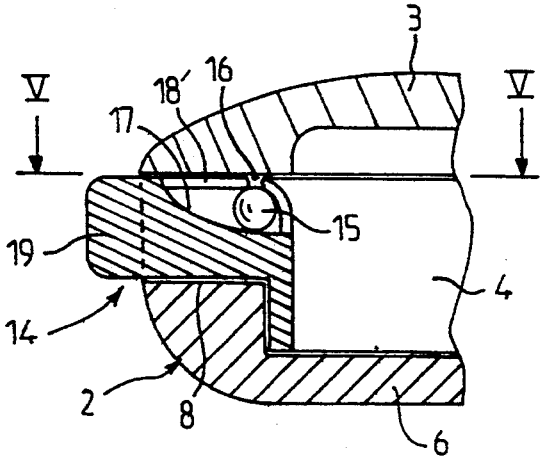
FIG. 4
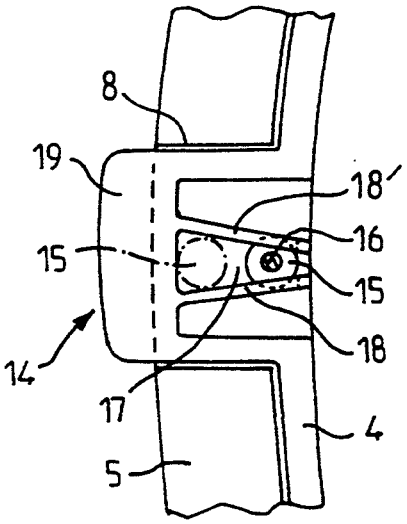
FIG. 5

CASE, INTER ALIA FOR MAKE-UP PRODUCTS, COMPRISING A CLOSING DEVICE THAT CAN BE OPERATED FROM THE OUTSIDE WITH AID OF A PUSH BUTTON

This is a continuation of application Ser. No. 07/845,814, filed on Mar. 9, 1992, which was abandoned upon the filing hereof, which is a continuation of Ser. No. 07/620,006, filed Nov. 30, 1990, now abandoned.

FIELD OF THE INVENTION

This invention relates to cases, inter alia for make-up products, comprising a closing device that can be operated from the outside with the aid of a push-button.

BACKGROUND OF THE INVENTION

In order to package and present make-up products such as eye make-up or powder, the perfume and cosmetics industries use numerous different types of cases containing insets of make-up or pressed powder, and possibly accessories such as applicator brushes. These cases usually comprise two elements, i.e. a base and a lid, said elements generally being moulded of relatively rigid plastic and being hinged on to one another. They may comprise a third element consisting of a shell disposed between the base and the lid and usually made of elastic material. These cases include a closing device that can be operated from the outside. FR-A-2 584 583 describes various closing devices in which the part of the opening device fixed to the lid generally consists of a hook.

SUMMARY OF THE INVENTION

This invention relates to a closing device for cases, inter alia for make-up products, in which the closure element fixed to the lid of the make-up case consists of a circular body, especially a sphere fixed to a rod, which cooperates with a ramp situated between two flexible guides integral with a push-button which can be actuated from the outside, elastic means returning the push-button to the closed position when the pressure exerted on the said button ceases.

This closing device, including a circular body, has the advantage of always allowing for slight tension and take-up of the tolerances existing between the lid and the base. In addition, the combination of flexible guides, ramp and circular body results in a catch which has a pronounced undercut, but which is nevertheless still very easy to open.

Therefore, this invention relates to a case, inter alia for make-up products, comprising a closing device including two elements, one of which consists of a circular body carried by a rod that can be operated from the outside with the aid of a push-button displaced by exerting pressure thereon, elastic means returning the push-button to the closed position when the pressure exerted on the said push-button ceases, and two main elements connected together by means of a hinge, one of the elements forming a base and the other forming a lid, the case possibly comprising a third element in the form of a shell, characterised in that the other element forming the device, connected to an element of the case other than the one carrying the circular body, is integral with the push-button and comprises a ramp sloping from the outside towards the inside of the case and two flexible guides disposed one on either side of the ramp, the two elements being associated with one another in such a way that when the push-button is displaced, the circular body is moved up the ramp, the said flexible guides exerting pressure on the said circular body until the said circular body is ejected beyond the said flexible guides.

The circular body is preferably a sphere. The circular body may also be ovoid or disc-shaped.

The guides may consist of plates or rails fixed by straps or some other means to the same element as the ramp, so as to be integral with the said ramp. They may also consist of non-recessed flexible strips, preferably carrying, on their edges situated near the uppermost part of the ramp, a thickened portion having a shape adapted to guide the circular body.

The flexible guides advantageously diverge in the ascending direction of the ramp.

In the case of the closing device according to the invention, pressing the push-button results in displacement of the ramp and the flexible guides relative to the circular body and the said circular body is forced between the two flexible guides which exert pressure on the said circular body. During this displacement, the circular body moves up the ramp, so that it is pushed beyond the guides and is displaced simultaneously in the direction of the divergence of the flexible guides until the spacing and elasticity of the flexible guides allow the circular body to be ejected by the guides. It then remains on the said guides, so that the case can be held half-open. The user can then stop exerting pressure on the push-button and can open the case completely by pivoting the lid and the base relative to one another about the hinge, in order, e.g. to remove the cosmetic product contained therein. When the user stops pressing the button, the elastic means return the button, and, consequently, the ramp and the flexible guides, to the closed position.

When the user wishes to close the case again, the lid and the base are brought closer together by pivoting them in the opposite direction about the hinge, after which the base and/or the lid is pressed so that the circular body penetrates between the two guides near the base of the ramp.

According to the invention, the first closing element consisting of the circular body is preferably fixed to the lid by means of its rod, the second closing element being fixed to the base or to a shell.

The push-button, the ramp and the flexible guides preferably form one single component obtained, in particular, by moulding.

According to a first embodiment of the invention, the push-button is displaced in translation when pressure is exerted thereon.

According to a first variant of this first embodiment, the push-button is integral with a shell of plastic material, e.g. polypropylene. This shell consists, in particular, of a frame fitting into the element forming the base. It is advantageously pivotally connected to the same hinge as the elements forming the base and forming the lid. The element forming the base preferably includes an indentation, so that the push-button fixed to the frame can project from the case when said case is closed.

As the frame consists of plastic material, it is deformed when the user presses the button, so that the said button can be displaced in translation. As the ramp and the flexible guides are integral with the push-button, they are also displaced in translation, forcing the circular body fixed to the lid to move up the ramp, advancing between the flexible guides until it is ejected beyond the guides, as described hereinabove. When the user stops pressing the button, the frame resumes its initial shape by virtue of its elasticity and returns the push-button to the closed position.

According to a second variant of the first embodiment, the push-button forms part of a drawer which slides along the inner surfaces of the lateral walls of the element of the case forming the base.

The base of the case is preferably lined with a supporting bottom fixed to the lateral walls of the base, and the drawer slides into the space defined between the base and the bottom.

The return means for the push-button are preferably leaf springs forming part of the drawer, which, in particular, are locked by lugs fixed to the bottom.

According to a second embodiment of the invention, the push-button is movable in rotation. The push-button is then preferably formed in one single piece with the ramp and the flexible guides, this component also including swivel pins rotatably mounted on the element forming the base of the case. The return means for the push-button preferably consist of leaf springs fixed to the component and coming to rest against stops disposed on the element of the case forming the base.

When the button is pressed, the component is turned on the swivel pins. Simultaneously, the circular body is forced to move up the ramp, being displaced between the flexible guides until it is ejected. The lid is then half-open.

The object of the invention will be understood more readily from the following description of various embodiments, illustrated in the accompanying drawings, in which:

BRIEF DESCRIPTION OF THE DRAWINGS

FIGS. 1 to 5 show a case according to the first variant of the first embodiment of the invention, wherein:

FIG. 1 is an isometric projection of the closed case;

FIG. 2 is an exploded perspective view of this same case, showing the different elements separated from one another;

FIG. 3 is a section along the line III—III of FIG. 1;

FIG. 4 is an enlarged view of FIG. 3, showing the closing device, and

FIG. 5 is a view along the line V—V of FIG. 4;

FIGS. 6 to 8 show a case according to the second variant of the first embodiment of the invention, wherein:

FIG. 6 is an exploded perspective view of the came;

FIG. 7 is an enlarged partial section of the case at the closing device, and FIG. 8 is a partial perspective view showing the ramp and the flexible plates;

FIGS. 9 to 14 show a case according to the second embodiment of the invention, wherein:

FIG. 9 is an exploded partial perspective view;

FIG. 10 is an internal front view of the push-button, along the line X—X of FIG. 12;

FIG. 11 is a side view in perspective of the push-button;

FIG. 12 is a sectional view along the line XII—XII of FIG. 10, and

FIGS. 13 and 14 are views similar to FIG. 12, showing different phases of the operation of the closing device, and FIGS. 15 and 16 show an embodiment of the invention in diagrammatic form, in which the flexible guides consist of non-recessed strips, wherein:

FIG. 15 is a partial front view of the case at the closure, and

FIG. 16 is a sectional view along the line XVI—XVI of FIG. 15.

DETAILED DESCRIPTION OF THE INVENTION

Figure 6:
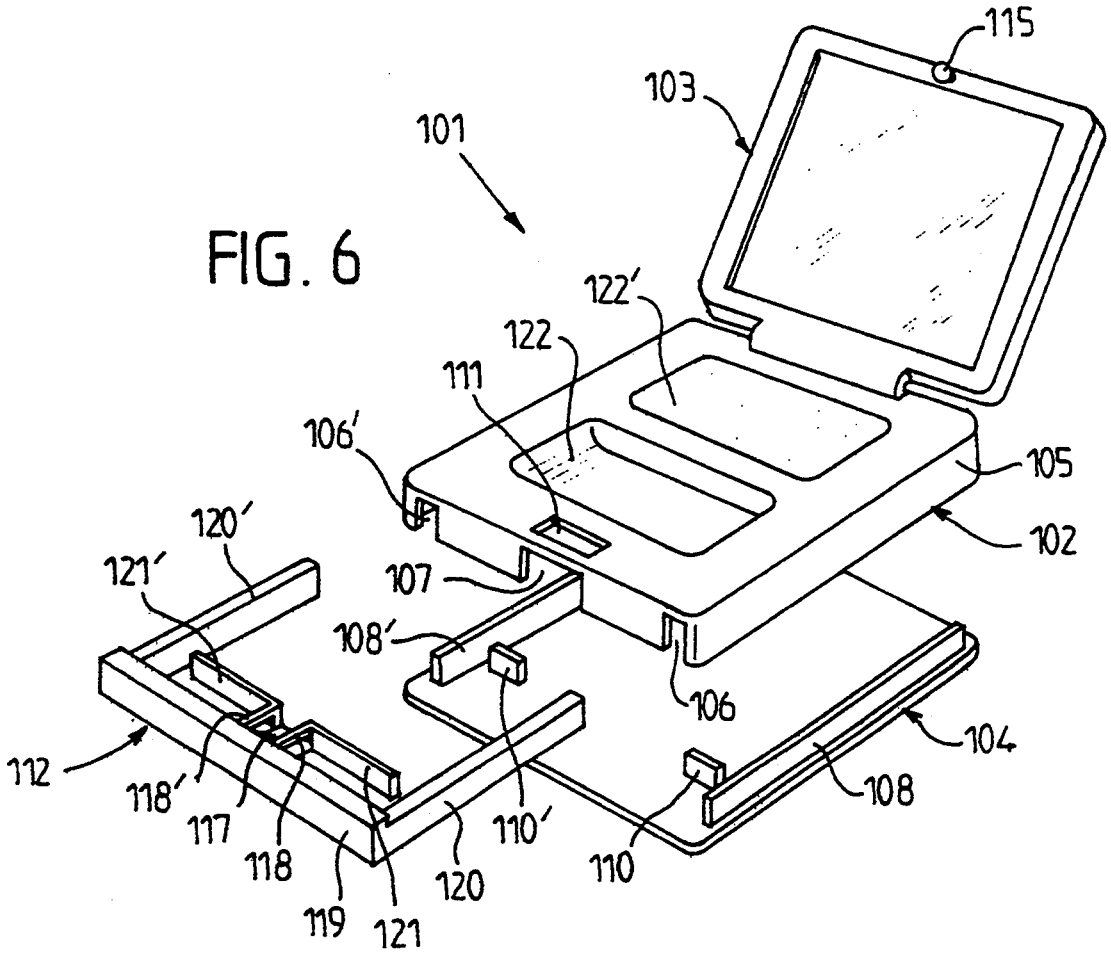

The case illustrated in FIGS. 1 to 5 is designated in general by the reference numeral 1. It consists of a first element forming the base 2, a second element forming the lid 3 and a third element forming a shell consisting of a frame 4. These three components are moulded of plastic material, the base 2 and the lid 3 of a relatively rigid plastic material such as polystyrene, and the frame 4 of a flexible plastic material, e.g. polypropylene. The base 2 has a rim 5 surrounding a flat or slightly dished bottom 6, except along part of the rear edge of the bottom, so as to define a clearance 7. A through opening 8 is formed in the front part of the rim 5. The lid 3, which is also flat or slightly dished, has the same shade in plan as the base, e.g. a substantially rounded rectangular shape, as illustrated in FIGS. 1 and 2, and is pressed against the upper face of the rim 5 of the base 2 in order to close the case 1. In its rear part, the lid 3 has a cylindrical portion 9, projecting under its inner face and extended at either side by means of a pin 10. The flexible frame 4 is mounted in the base 1 by means of elastic catch engagement. In its rear part, the frame 4 has a clearance 11 defined between two bosses 12 projecting towards the rear, each of which forms a hinge bearing for one of the two pins 10 of the lid 3. Each boss 12 is substantially in the form of a U-shaped element opening towards the bottom and defining a housing 13 in which the pin 10 is swivel-mounted. The lid 3 is therefore hinged on to the frame 4 by means of elastic catch engagement of the pins 10 in the housings 13 of the bosses 12 of the hinge, these in turn undergoing elastic catch engagement when the frame 4 is mounted in the base 2 by means of a system of recesses and lugs (not shown) of the rear clearance 7 of the base 2.

The closing device, designated in general by the reference numeral 14, includes a first element consisting of a sphere 15 mounted on the front edge (opposite the hinge) of the lid 3 by means of a rod 16 and a second element consisting of a ramp 17 and two guides consisting of flexible plates 18 and 18' diverging in the ascending direction of the ramp. This second element is integral with a push-button 19 as it is moulded together with the said push-button 19 and the frame 4. The shape of the push-button 19 is such that it is engaged in the through opening 8 formed in the rim 5 of the frame 4 and projects out from the case (see FIG. 1) when the case is closed.

When the user wishes to open the case, the button 19 should be pressed. By virtue of its elasticity, the frame 4 is deformed and the push-button can be displaced in translation towards the inside of the case, resulting simultaneously in translation of the ramp 17 and the flexible plates 18, 18'. In the closed position (see FIG. 4), the sphere 15 is disposed on the lowermost part of the ramp 17 and is held by the elastic plates 18, 18' in the zone in which they are closest together (see FIG. 5). As a result of the displacement of the ramp 17, the sphere 15 moves up said ramp and simultaneously moves between the plates 18 and 18' from the zone in which they are closest together (see the sphere shown by the solid lines in FIG. 5) towards the zone in which they are furthest apart (see the sphere shown by the dotted lines in FIG.

5), pushing against the plates 18 and 18' until the spacing and elasticity of the plates 18 and 18' allow the sphere 15 to be ejected. The case is then half-open and the user can open it completely by pivoting the lid 3 relative to the base 2. As soon as the user stops pressing the button 19, said button is returned to the closed position by virtue of the elasticity of the frame 4, the sphere 15 then being opposite the lowermost part of the ramp and the zone in which the plates 18 and 18' are closest together. When the user wishes to close the case again, the lid 3 is pressed, forcing the sphere 15 between the plates 18 and 18' until it rests on the lowermost part of the ramp, the flexible plates 18 and 18' then pressing against the sphere to hold it in position.

Figure 7:
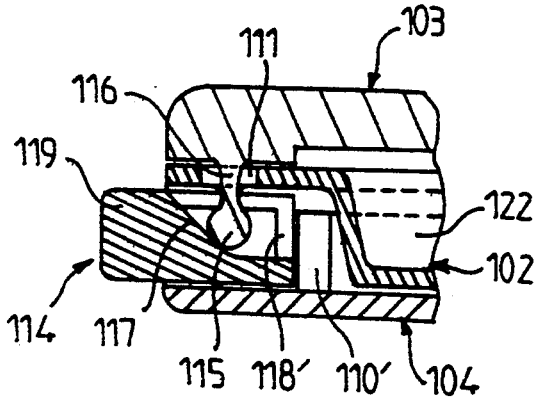
Figure 8:
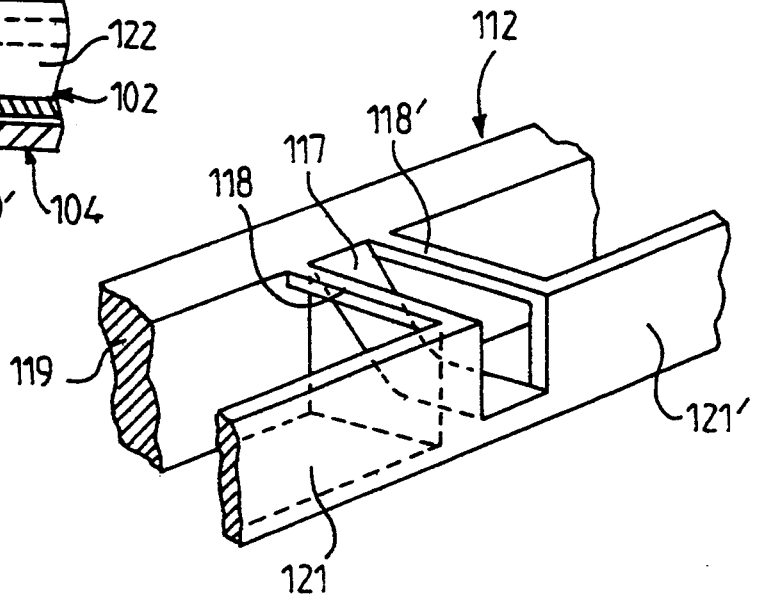
Figure 9:
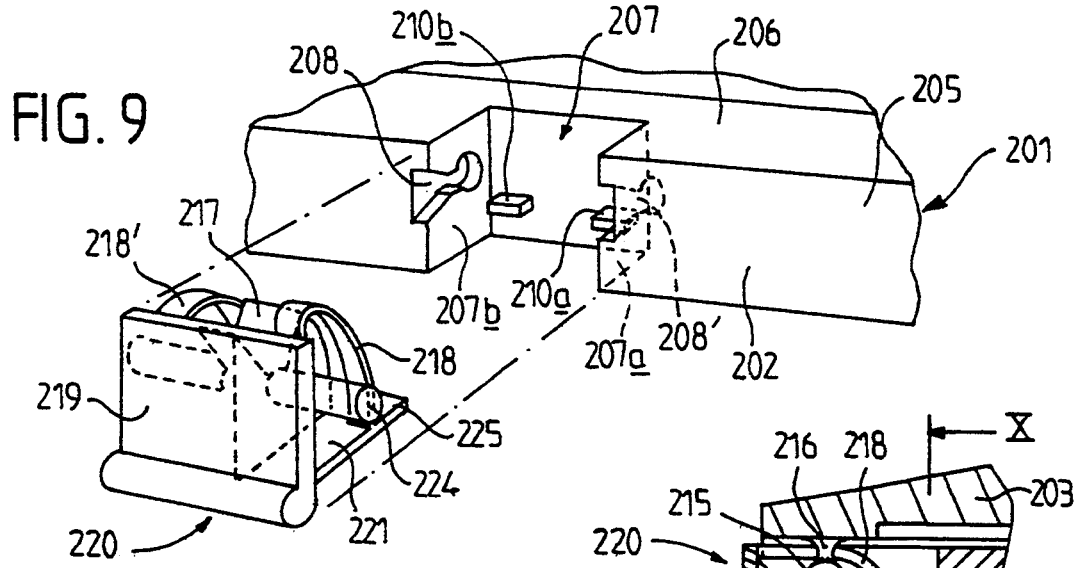

FIGS. 6 to 8 show a second variant of the first embodiment of the case according to the invention, the case in general being designated by the reference numeral 101. It includes a base 102, a lid 103 and a bottom 104 fixed to the outer face of the base 102. The case can be made of rigid plastic and, according to the variant shown in FIG. 6, has a rectangular shape.

The base includes a rim 105 provided on its front part (opposite the hinge) with two symmetrical lateral openings 106, 106' and a central opening 107. An opening 111 is provided on the part forming the plate of the base 102 in the vicinity of the front edge and at the centre of this edge. This opening is of sufficient size to be traversed by the sphere upon opening and closing of the case. According to the embodiment shown, the bottom 104, which is fixed under the rim of the base 102, includes two guide rails 108 and 108' capable of aligning with the external edges of the openings 106 and 106'.

On its inner face, the bottom 104 has two lugs 110 and 110' at a distance, towards the inside, from the rails 108, 108'.

The closing device in general is designated by the reference numeral 114. It includes a first element consisting of a sphere 115 fixed to the lid 103 by means of a rod 116 and a second element consisting of a drawer 112 comprising a ramp 117, two parallel flexible plates 118 and 118' and a push-button 119 in the shape of a parallelepiped having a length similar to the width of the case 101. At the two ends of the push-button 119, the drawer 112 is provided with two sliding arms 120 and 120' which are mounted to slide through the openings 106 and 106' into the space defined between the base 102 and the bottom 104, against the internal edges of the rails 108, 108' of the bottom 104. Two leaf springs 121, 121' are fixed via one of their ends to the lateral walls of the ramp 117, the opposite ends thereof being free.

In the closed position, the push-button 119 is disposed on the outside, in the vicinity of the front wall of the rim 105, so that it can be pushed in, the assembly formed by the ramp 117 and the flexible plates 118, 118' being disposed for the greater part inside the space defined between the base 102 and the bottom 104 so that it can slide through the opening 107 in the front wall of the rim 105. The sphere 115 is disposed at the bottom of the ramp 117 between the flexible plates 118, 118', the rod 116 carrying the sphere 115 passing through the opening 111 formed in the base 102 (see FIG. 7). The leaf springs 121, 121' are pressed without flexion against the lugs 110, 110' of the bottom 104.

Retaining means (not visible) are provided between the arms 120, 120' and the bottom 104, in order to prevent inadvertent displacement of the drawer 112 relative to the base 102.

When the user wishes to open the case 101, the button 119 is pressed, the arms 120 and 120' thereby sliding towards the inside. During the displacement of the push-button 119, the leaf springs 121 and 121' pressed against the lugs 110 and 110' flex owing to their elasticity. The ramp 117 and the flexible plates 118 and 118' which are integral with the push-button 119 also slide, forcing the sphere 115 to move up the ramp 117 between the flexible plates 118 and 118' until the sphere 115 is ejected beyond the plates 118, 118' at the opening 111. The case 101 is then half-open. The user can stop pressing the button and open the said case completely by pivoting the lid 103 about the hinge. The desired product can then be removed from the compartments 122 and 122' provided in the base 102.

As soon as the user stops pressing the button 119, the leaf springs 121, 121', by virtue of their elasticity, return it to the closed position, and when the user wishes to close the case 101, it is sufficient simply to press the lid 103 in order to force the sphere 115 through the opening 111, and then between the flexible plates 118 and 118', until it rests on the lowermost part of the ramp, the flexible plates 118 and 118' pressing against the said sphere 115.

FIGS. 9 to 14 show a case designated in general by the reference numeral 201. This case includes a base 202 and a lid 203 which can pivot relative to one another by virtue of a hinge (not shown). The base 202 consists of a hollow box formed of an upper plate 206 and a bottom 204, these being parallel and connected by means of a rim 205. A clearance 207 in the shape of a parallelepiped and including two lateral walls **207*a* and 207*b* is provided on the front edge (opposite the hinge). Two openings 208, 208' in the shape of keyholes are formed in the said lateral walls, the wider parts thereof being situated on the external edges of the lateral walls 207*a* and 207*b*. The wall of the bottom of the clearance 207 carries two stops 210*a* and 210*b*** directed towards the exterior.

The closing device of the case 201 is formed of a first element consisting of a sphere 215 fixed to the lid 203 by means of a rod 216 and a second element, designated in general by the reference numeral 220, comprising a ramp 217, two divergent flexible plates 218 and 218' and a push-button 219. The push-button 219 consists of a plate connected at one of its edges to a perpendicular plate 221 to which the ramp 217 is fixed. The flexible plates 218 and 218' are fixed, on the one hand, to the push-button 219 in the vicinity of its free rim, and, on the other hand, to the plate 221.

Figure 10:
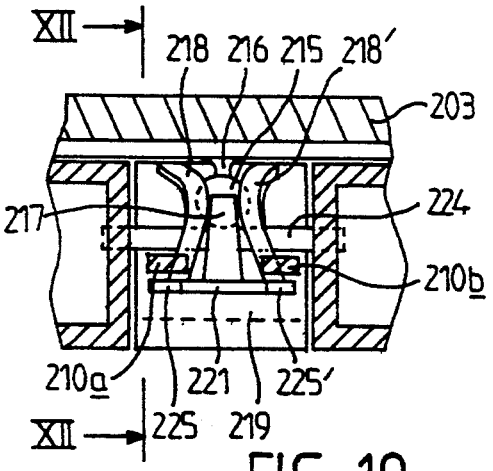
Figure 11:
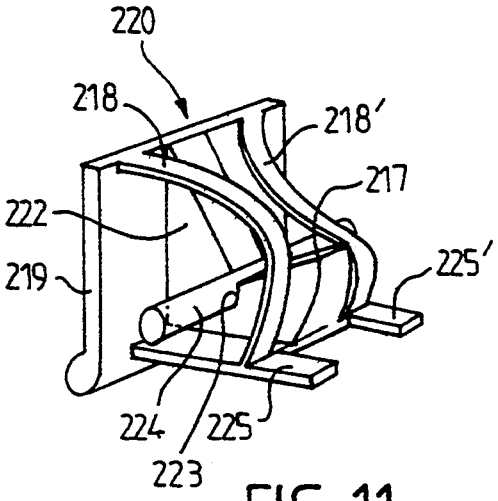

According to the embodiment shown in FIG. 10, the flexible plates first converge from the edge of the push-button 219 to the plane parallel to the push-button and passing through the lower edge of the ramp 217, and then diverge in the ascending direction of the ramp. The push-button 219 is provided with a central rib 222 situated between the planes perpendicular to the push-button 219 and to the plate 221 and provided with a housing 223 in which a pin 224 is fixed by snap engagement, said pin 224 projecting beyond the push-button 219 at either side. By virtue of this pin, the element 220 can be swivel-mounted by snap engagement in the openings 208, 208' of the clearance 207. The plate 221 carries two leaf springs 225 and 225' capable of coming to rest against the stops **210*a* and 210*b***.

Figure 12:
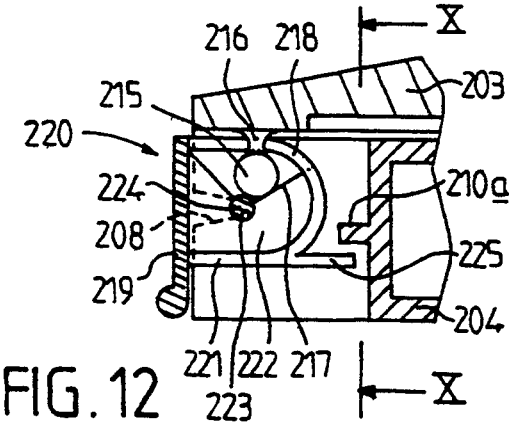
Figure 13:
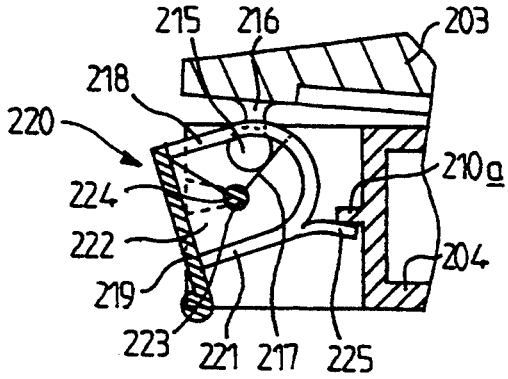
Figure 14:
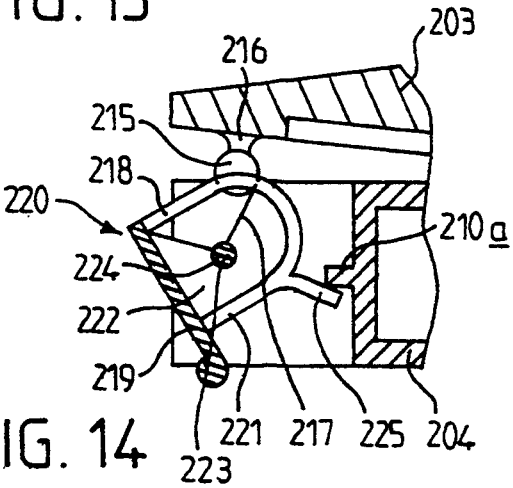

As shown in FIG. 12, in the closed position of the case 201, the sphere is disposed between the two flexible plates 218 and 218' in the zone in which they are closest together and rests on the ramp in the lowermost part thereof, in the vicinity of the pin 224. By pressing the button 219, the user rotates the element 220 in an anti-clockwise direction in FIGS. 12 and 13. The sphere 215 moves up the ramp 217 between the flexible plates 218 and 218' which diverge until the sphere 215 is ejected (FIG. 14). The case is half-open. Simultaneously, the leaf springs 225 and 225' come to rest against the stops 210*a* and 210*b* (see FIGS. 13 and 14). When the user stops pressing the button 219, the leaf springs, by virtue of their elasticity, return the element 220 by elasticity to the closed position of the case 201.

When the case 201 is half-open, the user can open it completely by turning the lid 203 relative to the base 202 about the hinge.

When the user wishes to close the case 201, the lid 203 is pressed, in order to force the sphere 215 between the flexible plates 218 and 218' until it rests on the lowermost part of the ramp, the plates 218 and 218' pressing against the said sphere 215.

Figure 15:
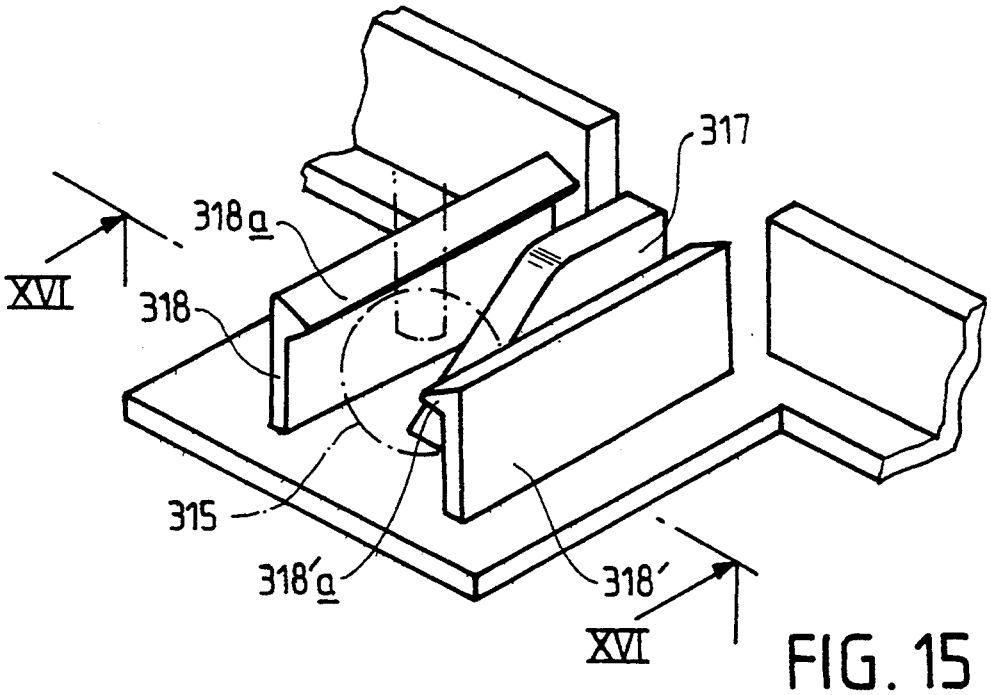
Figure 16:
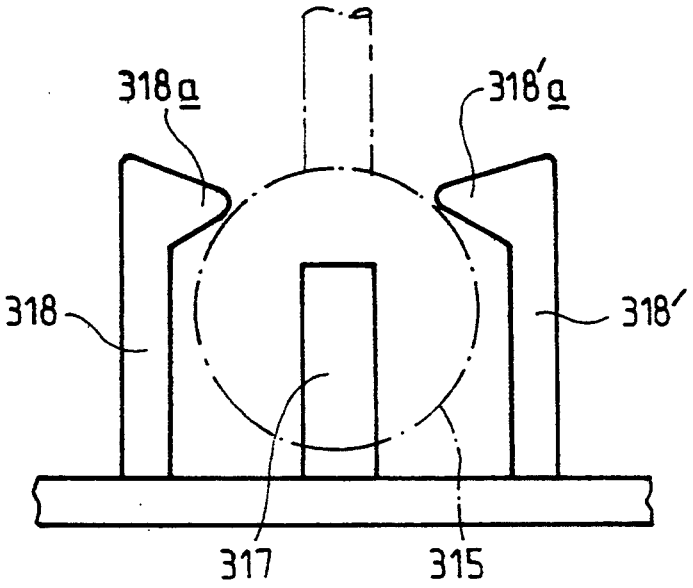

FIGS. 15 and 16 show a closing device in diagrammatic form, in which the guides consist of non-recessed flexible wall members 318 and 318' disposed one on either side of a ramp 317. On their free edges situated in the vicinity of the upper part of the ramp 317, the wall members 318 and 318' have a thickened portion 318*a*, 318'*a* which, in transverse section, has an approximately triangular shape adapted to guide the ball 315 (shown by the dash-dotted lines in FIG. 16).

I claim:

1. A case for a make-up product comprising a base and a lid hingedly attached to said base and movable relative thereto between an open and closed position, said base having a space receiving a member including a push button and a ramp surface movable with said push button along an axis with said ramp surface sloping relative to said axis from one end of said ramp surface toward the opposite end thereof, said lid having a body connected to a portion thereof by connecting means so that said body will be engageable by a portion of said ramp surface when said lid is in said closed position and said push button is actuated, said member including a pair of flexible members disposed adjacent said ramp surface and which engage said body when said lid is in the closed position, the slope of said ramp surface being such that said body is ejected beyond said flexible members by said ramp surface when said push button is pushed by a user to move said push button from a deactuated to an actuated position, said base including elastic means for returning said push button to said deactuated position, said flexible members comprising a pair of flexible strip members each standing on one side of said ramp surface, each strip member having a portion for engaging said body between said strip members when said push button is in said deactuated position, said strip members extending generally parallel to said axis and said push button, said flexible members and said ramp surface being molded as a single component, said ramp surface extending over a selected length and said flexible strip members extending over said selected length; said flexible strip members each being made of plastic material and being spaced apart a distance so that said strip members exert pressure on said body at least during movement of said push button along said axis until said body is ejected from between said strip members by said ramp, said axis being a rectilinear axis, said push button including drawer means and said base including means for receiving said drawer means, said base including a button wall and side walls and a product carrying surface connected to said side walls with said side walls spacing said product carrying surface from said bottom wall with said drawer means having arms received in openings in one of said side walls and extending into the space between said product carrying surface and said bottom wall.

* * * * *